United States Patent [19]

Harley et al.

[11] 4,078,716

[45] Mar. 14, 1978

[54] VEGETABLE TRAYS

[75] Inventors: David N. Harley, Bournemouth; John P. Palmer, Reading, both of England

[73] Assignee: ITW Limited, Slough, England

[21] Appl. No.: 813,555

[22] Filed: Jul. 7, 1977

[30] Foreign Application Priority Data

Jul. 10, 1976 United Kingdom ..... 28806/76

[51] Int. Cl.[2] ..... B65D 57/00; A44B 21/00

[52] U.S. Cl. ..... 229/49; 24/81 BF

[58] Field of Search ..... 229/49; 24/81 BF

[56] References Cited

U.S. PATENT DOCUMENTS

| | | | |
|---|---|---|---|
| 236,710 | 1/1881 | Lieb | 229/49 X |
| 254,115 | 2/1882 | Comstock | 229/49 UX |
| 2,379,179 | 6/1945 | Petersen | 229/49 UX |
| 2,961,139 | 11/1960 | Nobili | 229/49 X |
| 3,220,633 | 11/1965 | Swane | 229/49 |
| 3,223,309 | 12/1965 | Chiorri | 229/49 |
| 3,226,008 | 12/1965 | Chiorri | 229/49 |
| 3,760,465 | 9/1973 | Brennan | 229/49 |

FOREIGN PATENT DOCUMENTS

| | | | |
|---|---|---|---|
| 1,436,626 | 3/1966 | France | 229/49 |
| 6,414,084 | 6/1966 | Netherlands | 229/49 |

*Primary Examiner*—Davis T. Moorhead
*Attorney, Agent, or Firm*—Robert W. Beart; J. R. Halvorsen

[57] ABSTRACT

The invention concerns corner posts for use with card blanks to form stacking trays, especially suited to transporting garden produce. Corner posts of the invention are elongated elements of substantially right triangular cross-sectional shape having a widest face and two narrower faces, said widest face being formed with two longitudinally extending slots, said slots each having two parallel sides and a base and opening onto said widest face, said sides of one of said slots extending in planes perpendicular to said sides of the other of said slots, and each of said slots having an abutment surface extending in a plane at right angles to said sides and said base and constituting an end to said respective slot, each slot further including an undercut adjacent its said opening to provide a shoulder facing said base of said slot, said slot having a width substantially twice that of said opening of said slot at points between said shoulder and said base.

Corner posts of the invention may be formed with end portions adapted to locate two like posts in axial alignment, so that the trays may be stacked up.

6 Claims, 8 Drawing Figures

VEGETABLE TRAYS

This invention concerns improved methods and components for the construction of stacking trays for use with market garden produce.

Hitherto, trays for the transportation of market garden produce from the field to the retailer have been folded from card blanks, the blanks having wooden corner posts of triangular cross-section stapled to the inside of the sides of the tray at the corners, to allow trays to be stacked up. The card is usually treated with a water-resistant coating, to prolong its life. The corner posts extend above the sides of the trays so that when the trays are stacked up circulation of air amongst the trays in a stack is possible.

Trays of this type are either taken to the fields ready-assembled, in which case the empty trays are bulky and difficult to handle, or the card blanks and corner posts are delivered to the field where the trays are assembled using staples. Assembling the trays in the field presents problems in that a considerable amount of capital must be employed in the provision of stapling machines, and the wastage of staples and other materials is great. Rusting of the staples may also cause the contents of the tray to be rendered unsaleable due to the rust marking the produce in the tray.

The present invention provides simple and effective components for use in making trays, each tray being assembled from a single card blank and four corner posts, no fasteners being necessary. The trays of the present invention have no metal parts and are thus impervious to rust, and the absence of sharp edges facilitates safe handling of the trays and components.

A card blank for use with the corner posts of the present invention in making a tray is of generally rectangular shape and has fold lines arranged to define the base of the tray, the fold lines delineating a second, smaller, rectangle on the card blank. At each corner of the card blank, an area of card is removed so that the sides of the tray are of substantially the same length as the sides of the base to which they are attached. In addition, at each corner of the base of the tray, a small triangular area is removed effectively cutting off the corners of the base.

A corner post according to the present invention comprises an elongated element of substantially right triangular cross-sectional shape, the post having two longitudinally extending slots in its widest face, the slots each having two parallel sides, and a base, and opening on to the widest face of the post, the sides of one slot being arranged in planes perpendicular to the sides of the other slot and each slot having at one end an abutment surface extending in a plane transverse to the axis of the post, the abutment surfaces intersecting the sides and bases of the slots at right angles, and each slot having an undercut lip to provide a shoulder near the opening of the slot, the shoulder facing the base of the slot, the width of the slot between the base of the slot and the shoulder being substantially twice the width of the opening of the slot.

Preferably, the corner post includes a support portion extending from one end of the post, and adapted to nest with a second corner post placed in axial alignment with it. The support portion advantageously extends on the side of the abutment surface remote from the slots.

A tray constructed from components according to the invention will now be described with reference to the accompanying drawings, in which.

Figure 4:
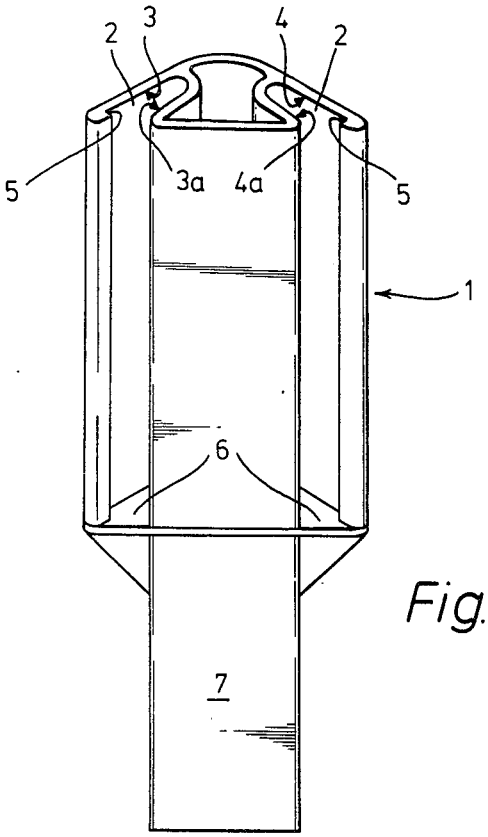
FIG. 4 is a perspective view of a corner post according to the invention.

Referring now to FIG. 4 of the drawings, a corner post 1 is an elongated component of generally right triangular cross-sectional shape. Two slots 2, having generally parallel sides 3, 3*a*, 4 and 4*a*, respectively, are formed in the widest face of the corner post. The sides 3 and 3*a* of one slot 2 are inclined at angles of 90° to the sides 4 and 4*a* of the other slot 2. The slots have an undercut lip, to provide inwardly facing longitudinal shoulders 5 adjacent the openings of the slots.

Abutment surfaces 6 arranged transversely to the slots are provided at one end of the slots 2, and the corner post is formed with a support portion 7 at its lower extremity, the support portion extending on the side of the abutment surfaces 6 remote from the slots.

Figure 2:
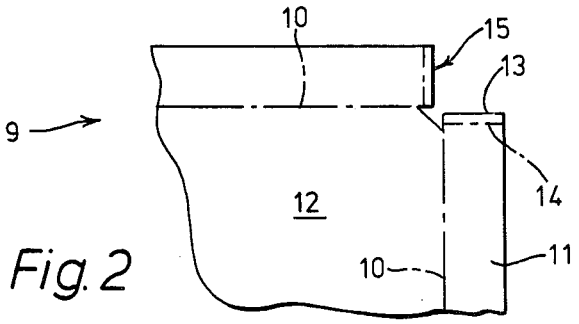
FIG. 2 shows the configuration of one corner of the card blank prior to assembly.

To assemble a tray using the corner post shown in FIG. 4, a card blank 9, one corner of which is shown in FIG. 2, is first folded along the fold lines 10 to form a tray with raised sides 11 and a base 12. The end portions 13 of the sides 11 are then folded about fold lines 14 to lie on the outer surfaces of the sides 11.

Figure 3:
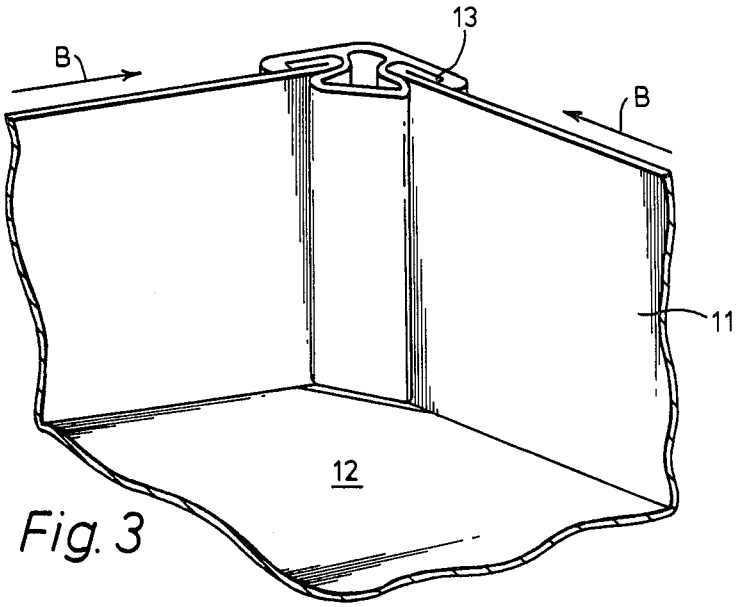
FIG. 3 is an enlarged view of the corner A of the tray of FIG. 1.

The corner post is assembled to the card blank by aligning the end portions 13 with the slots 2 and pushing the sides in the directions shown in FIG. 3 by the arrows 'B', whereupon the folded over end portions of the sides enter the slots. The abutment surfaces 5 engage the folded back end edges 15 of the sides to prevent withdrawal of the sides of the tray from the corner post and in doing so an audible "click" is produced, indicating that the post is securely fastened to the end of the side. To complete the assembly, the sides 11 are pushed down to rest on the abutment surfaces 6.

It will be readily understood that the tray may be dismantled by sliding the sides 11 out of the slots 2 in the axial direction of the corner posts.

Figure 1:
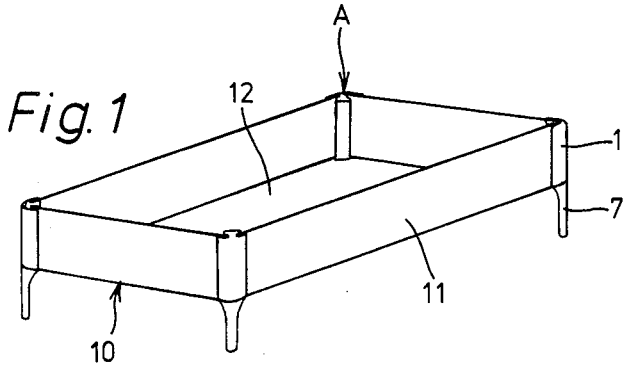
FIG. 1 is a perspective view of a complete tray.
Figure 6:
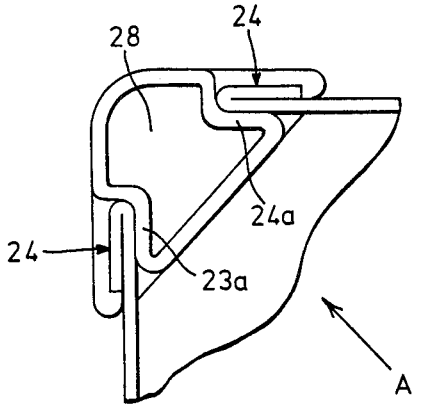
FIG. 6 is a plan of a third type of corner post according to the invention seen in position on the corner of a tray.
Figure 7:
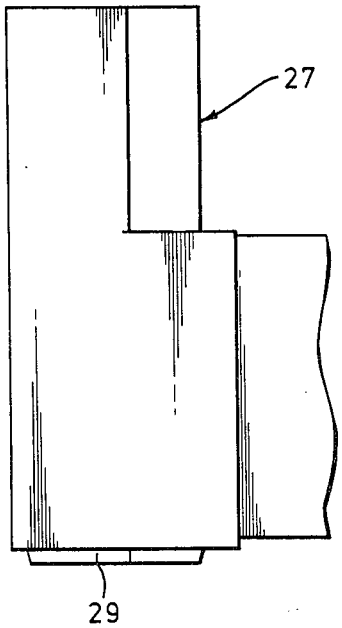
FIG. 7 is a side view of the corner post of FIG. 6.
Figure 8:
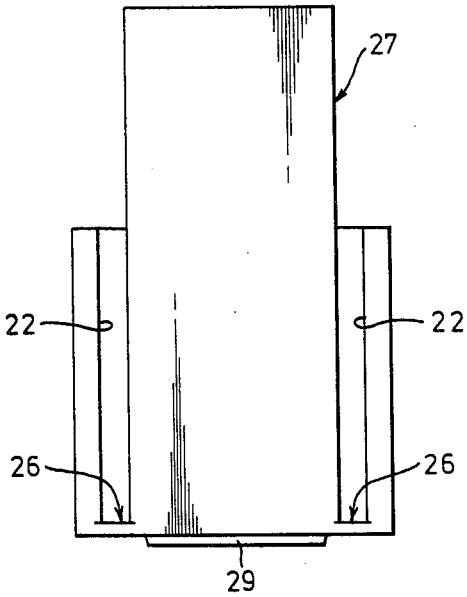
FIG. 8 is a view taken in the direction of arrow 'A' in FIG. 6, with the card blank removed.

In FIGS. 6, 7 and 8 there is shown a further embodiment of the invention, the corner post being of similar construction to that shown in FIG. 1.

In the embodiment shown in FIGS. 6, 7 and 8, the corner post has two slots 22, extending upwards from abutment surfaces 26. Preferably, the abutment surfaces are on the upper face of a triangular base plate 28. The slots have the same relative orientation as in the embodiments shown in FIGS. 1 to 4, i.e. the two sides of each slot are in planes perpendicular to the sides of the other slot.

The slots terminate intermediate the length of the corner post, an upstanding support portion 27 extending axially of the corner post projecting above the ends of the slots 22. The support portion is, in the embodiment shown, a thin-walled hollow section.

In order to improve the stability of a stack of trays, a lug 29 is formed on the undersurface of the triangular base plate 28. The lug may have any shape suitable to cooperate with the upper end of a second corner post to prevent the posts moving out of alignment when trays including the posts are stacked one above another. The lug 29 shown in FIGS. 7 and 8 is intended to rest inside the end of the support portion 27 of a second corner post.

Alternatively, the corner post may be provided with abutment surfaces in the slots only, no base plate such as 28 being present. In this case, any locating lugs would be formed on the underside of the abutment surfaces 26 to engage the outer surface of the support portion 27 of a second corner post.

Various improvements and modifications may be made to the corner post without departing from the original invention. These include forming the corner posts in such a way that there are support portions 7 above and below the tray when assembled, and the provision of a spring tine or other retaining means to prevent removal of the base and sides of the tray from the corner post by preventing relative axial movement between the base and the corner post when the base rests on the abutment surfaces 6.

The corner posts may be each an individual integral plastics moulding, or they may be produced from extruded strips by first cutting the strips into suitable lengths, then forming the abutment surfaces 6 by deforming the outer walls 3 and 4 of the slots 2.

Alternatively, the corner posts may be provided with fingers extending from the face of the corner post between the slots 2, instead of the abutment surfaces 6.

Locating means may also be provided on the ends of the corner posts, to facilitate stacking. These may take the form of lug and socket devices, each corner post being formed with a lug at one end and a socket at the other in which a lug of another corner post may locate. Extruded corner posts may either be formed with locating surfaces during parting-off, or have locating surfaces formed on them subsequently.

As an alternative to forming the shoulders 5 on the outer sides 3 and 4 of the slots 2, one or both of the shoulders 5 may be formed on either or both of the inner sides 3*a* and 4*a;* if this is the case then the end portions 13 of the sides 11 of the card blank must be folded inwards during assembly of the tray.

Figure 5:
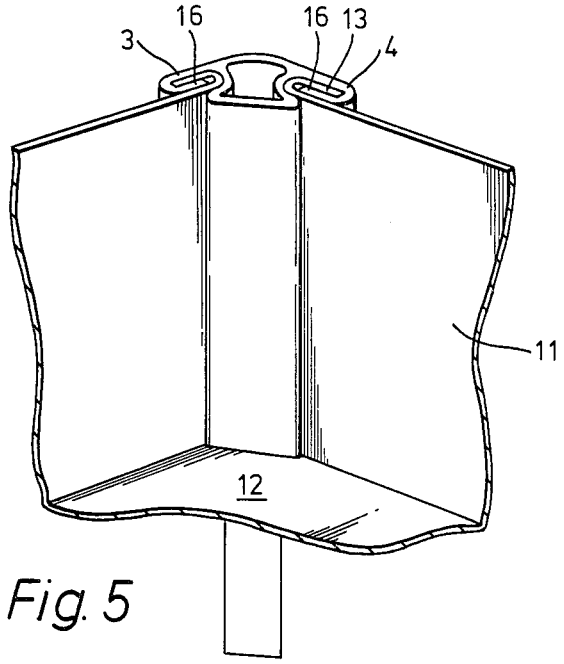
FIG. 5 shows a second type of corner post.

A further type of corner post is illustrated in FIG. 5. The post shown in FIG. 5 has a cross-section similar to that shown in FIGS. 3 and 4, the difference being that tongues 16 are formed at the free ends of the shoulders formed on the outer walls 3 and 4 of the slots 2, the tongues dividing the slots each into two communicating sections, the tongues being interposed between the sides 11 of the card blank and the end portions 13 when the corner post is assembled for use. To assemble the corner post shown in FIG. 5 to the card blank, the sides 11 are first folded up to their assembled positions. The post is positioned below the base of the blank, with the slots 2 in alignment with the sides 11, and the post is then slide upwards in the direction of its axis to engage the end portions of the sides.

Advantageously the posts are formed from plastics material as integral mouldings. The posts may be made solid, or hollow as shown in the drawings to save material.

We claim:

1. A corner post for use in a stacking tray, said post being an elongated element of substantially right triangular cross-sectional shape having a widest face and two narrower faces, said widest face being formed with two longitudinally extending slots, said slots each having two parallel sides and a base and opening onto said widest face, said sides of one of said slots extending in planes perpendicular to said sides of the other of said slots, and each of said slots having an abutment surface extending in a plane at right angles to said sides and said base and constituting an end to said respective slot, each slot further including an undercut adjacent its said opening to provide a longitudinal shoulder facing said base of said slot, said slot having a width substantially twice that of said opening of said slot at points between said shoulder and said base.

2. A corner post according to claim 1, wherein one end of said post is formed with a support portion adapted to engage the other end of a second, identical, corner post to locate said post and said second post in axial alignment.

3. A corner post according to claim 2, wherein said abutment surfaces are coplanar.

4. A corner post according to claim 3, wherein said abutment surfaces are situated intermediate the length of said corner post.

5. A corner post according to claim 3, wherein said abutment surfaces are situated at one end of said corner post.

6. A corner post according to claim 1, wherein each said shoulder is formed with a tongue extending from the edge of said shoulder towards said base of each of said slots, said tongues dividing said slots each into two communicating sections.

* * * * *